US007773678B2

(12) United States Patent
Marsili

(10) Patent No.: US 7,773,678 B2
(45) Date of Patent: Aug. 10, 2010

(54) METHOD AND APPARATUS FOR REDUCING THE DYNAMIC RANGE OF A RADIO SIGNAL

(75) Inventor: Stefano Marsili, Fuernitz (AT)

(73) Assignee: Infineon Technologies AG, Neubiberg (DE)

( * ) Notice: Subject to any disclaimer, the term of this patent is extended or adjusted under 35 U.S.C. 154(b) by 875 days.

(21) Appl. No.: 11/156,144

(22) Filed: Jun. 17, 2005

(65) Prior Publication Data

US 2006/0008015 A1 Jan. 12, 2006

(30) Foreign Application Priority Data

Jun. 17, 2004 (DE) ..... 10 2004 029 236

(51) Int. Cl.
*H04K 1/00* (2006.01)

(52) U.S. Cl. ..... 375/260; 375/130; 375/142; 375/143; 375/148; 375/150; 375/152; 375/222; 375/267; 375/295; 375/296; 375/335; 375/355

(58) Field of Classification Search ..... 375/260, 375/142, 143, 130, 148, 150, 222, 295, 267, 375/296, 345, 355
See application file for complete search history.

(56) References Cited

U.S. PATENT DOCUMENTS 6,330,289 B1 * 12/2001 Keashly et al. ..... 375/297
7,174,139 B2 * 2/2007 Lipka et al. ..... 455/113
7,266,156 B2 * 9/2007 Montojo et al. ..... 375/267
7,352,704 B1 * 4/2008 Toussi et al. ..... 370/238
2003/0202611 A1 10/2003 Montojo et al. ..... 375/260

FOREIGN PATENT DOCUMENTS

CN 1404251 A 3/2003
WO 03092235 A1 11/2003

OTHER PUBLICATIONS

3rd Generation Partnership Project; Technical Specification Group Radio Access Network; Spreading and modulation (FDD), 3GPP TS 25.213 V5.3.0 (Mar. 2003) Spreading and Modulation (FDD) (Release 5), 28 pages.
Universal Mobile Telecommunications Systems (UMTS); UTRA (BS) FDD; Radio Transmission and reception (3GPP TS 25.104 V 6.2.0 Release 6); ETSI TS 125 104 V6.2.0, 60 pages, Jun. 2006.

(Continued)

*Primary Examiner*—Shuwang Liu
*Assistant Examiner*—Dhaval Patel
(74) *Attorney, Agent, or Firm*—Dicke, Billig & Czaja, PLLC

(57) ABSTRACT

In a method for reducing the dynamic range of a multicarrier transmission signal (12') which is formed in a transmitter and is composed of two or more carriers, the various signal structure timings of the carriers are determined. A delay unit (100; D0, D1, . . . , DN-1) is then used to set a delay profile between the signal structure timings of various carriers, in such a manner that the signal structures of different carriers or substructures of them are not aligned in time with respect to one another.

23 Claims, 6 Drawing Sheets

OTHER PUBLICATIONS

3rd Generation Partnership Project; Technical Specification Group Radio Access Network; Base Station (BS) Conformance testing (FDD) (Release 6), 3GPP TS 25.141 V6.2.0 (Jun. 2003), 159 pages.
3rd Generation Partnership Project; Technical Specification Group Radio Access Network; Physical channels and mapping of transport channels onto physical channels (FDD) (Release 5). 3GPP TS 25.211 V5.4.0 (Jun. 2003), 51 pages.
Wright, Andrew, Multi-Carrier WCDMA Basestation Design Considerations-Amplifier Lineration and Crest Factor Contol, Technology White Paper, 34 pages.
Thomas May et al., "Reducing the Peak to Average Power Ration in OFDM Radio Transmission Systems", VTC, pp. 2474-2478, 1998.
Nabil Hentati et al., "Additiv Algotithm for Reduction of Crestfactor (AARC)", 3 Pages.
Olli Vaananen et al., "Effect of Clipping in Wideband CDMA System and Simple Algorithm for Peak Windowing," Electronic Circuit Design Labratory, pp. 614-618.
Chinese First Office Action for Chinese Patent Application No. 200510078551.0 dated Dec. 26, 2008 (12 pages including translation).

* cited by examiner

METHOD AND APPARATUS FOR REDUCING THE DYNAMIC RANGE OF A RADIO SIGNAL

CROSS-REFERENCE TO RELATED APPLICATION

This application claims priority from German Patent Application No. 10 2004 029 236.1, which was filed on Jun. 17, 2004, and is incorporated herein by reference in its entirety.

TECHNICAL FIELD

The invention relates to a method and an apparatus for reducing the dynamic range of a multicarrier transmission signal, which is formed in a transmitter and is composed of two or more carriers.

BACKGROUND

It is already known that base stations in mobile radio systems emit a multicarrier transmission signal in the downlink (that is to say on the radio path from the base station to the mobile radio stations). The multicarrier transmission signal includes the signal streams which are intended for the various mobile stations. The characteristic of the multicarrier transmission signal is that two or more carriers (typically adjacent frequency bands) are used, with the signal streams split between them. Multicarrier signal transmission is used in the downlink in many mobile radio systems, for example GSM (Global System for Mobile Communications). Multicarrier transmission signals can also occur in the downlink in CDMA (Code Division Multiple Access) third-generation mobile radio systems, which use spread coding of the individual signal streams for subscriber separation. By way of example, the WCDMA (Wideband Code Division Multiple Access) signal in the UMTS (Universal Mobile Telecommunications System) mobile radio system can optionally be transmitted using the UTRA FDD (Universal Terrestrial Radio Access Frequency Division Duplex) mode in the downlink via two or more frequency channels, each with a channel bandwidth of 5 MHz.

The definition of the WCDMA downlink signal in the UMTS Standard is specified in the 3GPP Standard TS 25.213 v5.3.0 (2003-03) Spreading and Modulation (FDD).

Downlink signals which are emitted from base stations, that is to say including multicarrier transmission signals, typically have to comply with specific quality requirements. For UMTS, these quality requirements relating to the UTRA FDD mode are specified in the 3GPP Standards TS 25.104 v6.2.0 (2003-06) Base Station (BS) radio transmission and reception (FDD) and TS 25.141 v6.2.0 (2003-06) Base Station (BS) conformance testing (FDD). The requirements defined in the Standards state that, when using specific reference signals (which are defined in the Standards), measurements of various quality variables must be carried out, in which case the measured values must be within a tolerance band that is specified in the Standard. Five different test modes (test modes 1 to 5) with different reference signals and the quality variables (EVM (Error Vector Magnitude), PCDE (Peak Code Domain Error) and ACLR (Adjacent Channel Leakage power Ratio) are defined in the abovementioned Standards.

A multicarrier transmission signal which is formed in a base station is composed of a large number of signal streams, with each signal stream being associated with one specific carrier. As will be explained in more detail in the following text, this multicarrier transmission signal also has to be raised to the desired radio-frequency transmission band and has to be amplified by means of a power amplifier before it is emitted via the antenna. During the process, the difficulty arises that the multicarrier transmission signal has a wide dynamic range, owing to the large number of carriers and signal streams associated with them. The power amplifier is that component of the base station which is most affected by the wide dynamic range. This is because the power amplifier has to have a linear response over its entire input dynamic range. If a power amplifier with an excessively narrow linear input dynamic range is chosen, the quality requirements which are specified in the abovementioned Standards relating to the emitted signal cannot be complied with. This means that:

- the power amplifier in a base station for transmission of a multicarrier transmission signal must have an "overdesigned" linear input dynamic range in order to comply with the stringent dynamic range requirements,
- a more complex cooling system is required for an overdesigned power amplifier,
- the requirements for the power supply system for the power amplifier are more stringent, and
- the electrical power consumption of the power amplifier is greater.

All of the items mentioned increase the costs for the network operator, and in this context it should be noted that the power amplifier is typically the most expensive component in a base station.

One possible way to use lower-cost power amplifiers with a narrower linear input dynamic range is to provide a dedicated power amplifier for the signal streams of each carrier. In this case, the individual power amplifiers do not require such a wide linear input range. The disadvantage of this procedure is, however, that a number of power amplifiers (one power amplifier per carrier) are required, thus cancelling out the cost advantage.

Another possibility is to reduce the dynamic range of the multicarrier transmission signal. In this case, the (single) power amplifier may have a narrower linear input dynamic range.

A first known technique for reducing the dynamic range of the multicarrier transmission signal is to superimpose pulses on the multicarrier transmission signal in the passband or in the low-frequency band, which compensate for signal peaks in the multicarrier transmission signal, so that these are brought within a desired threshold value. This technique is proposed in the documents "Multi-Carrier WCDMA Basestation Design Considerations—Amplifier Linearization and Crest Factor Control"—White Paper—Andrew Wright—PMC Sierra—Aug. 1, 2002, "Reducing the Peak-to-Average Power Ratio in OFDM Radio Transmission Systems",—T. May, H. Rohling, Proc. IEEE VTC '98, Phoenix May 1998, and "Additive Algorithm for Reduction of Crest factor"—N. Hentati, M. Schrader—5th International OFDM Workshop 2000, Hamburg.

A further technique for reducing the dynamic range of a multicarrier transmission signal is specified in the document "Effect of Clipping in Wideband CDMA system and simple algorithm for Peak Windowing", O. Väänänen, J. Vankka, K. Halonen, 2002 World Wireless Congress. This document proposes that the multicarrier transmission signal be attenuated when signal peaks occur, such that the signal is below a desired threshold value.

SUMMARY

One disadvantage of the cited techniques is that they also result in non-linear distortion of the multicarrier transmission signal (although admittedly also reduced with respect to the dynamic range). To this extent, when using these techniques, care must be taken to ensure that the linearity improvement which is produced by narrowing the dynamic range is not cancelled out in the amplification process by the non-linear distortion that has already occurred in the multicarrier transmission signal.

The invention is based on the object of specifying a method for reducing the dynamic range of a multicarrier transmission signal which is formed in a transmitter and is composed of two or more carriers, which method results in as little linear distortion of the multicarrier transmission signal as possible. A further aim of the invention is to provide an apparatus for reducing the dynamic range of a multicarrier transmission signal which is formed in a transmitter, is composed of two or more carriers and has the characteristics mentioned above.

According to an exemplary embodiment, a multicarrier transmission signal is considered in which each carrier has specific associated signal streams, the signal streams have the same repeating signal structure, and signal streams which are associated with the same carrier have a common signal structure timing. A method for reducing the dynamic range of a multicarrier transmission signal such as this which is formed in a transmitter comprises the steps of determining the signal structure timings of the carriers, of delaying the signal streams which are in each case associated with one carrier, in such a way that the signal structures of different carriers or substructures of them are not aligned in time with respect to one another, and of producing the multicarrier transmission signal by combination of the signal streams on the carriers.

The invention is based on the knowledge that even when different signal streams (which, for example, can also be coded using different spreading codes) are transmitted, these signal streams may nevertheless contain specific signal sections with signal values that are identical to one another or, in a more general form, are not distributed randomly. In order to avoid such signal sections being constructively added during combination of the signal streams on the carriers (that is to say forming a signal peak in the multicarrier transmission signal), those signal streams whose signal structures need not necessarily be synchronous (that is to say they need not necessarily have a common signal structure timing)—these are the signal streams associated with the various carriers—are delayed with respect to one another such that the signal structures or substructures of them are not aligned in time with respect to one another. This means that signal sections with identical signal values or signal values which are not randomly distributed in the multicarrier transmission signal no longer occur at the same time, thus preventing the formation of a signal peak.

It should be mentioned that, in the method according to the invention for reducing the dynamic range of the multicarrier transmission signal, no non-linear distortion whatsoever is caused in the multicarrier transmission signal. The disadvantages of the methods which are known from the prior art therefore do not occur with the method according to the invention.

The signal structure is preferably a frame or a time slot. In this case, the method according to the invention is carried out in such a way that different carriers (to be more precise: the signal streams associated with different carriers) have different frame timings or different time slot timings.

It is feasible for the signal sections with signal values which are not distributed randomly for different carriers also still to be aligned in time with respect to one another when the carriers have different signal structure timings (that is to say different frame or time slot timings). By delaying the signal streams which are in each case associated with one carrier in such a way that chip groups comprising SF chips, where SF is a spreading factor, are not aligned in time with respect to one another, it is always possible to ensure that sections with signal values which are not distributed randomly in the various carriers are separated in time and are thus asynchronously superimposed on one another.

One advantageous refinement of the method is characterized in that the signal streams comprise a sequence of chips, produced by spread coding of symbols, and in that the signal streams in each signal structure or substructure comprise a section with chips which do not occur randomly, in particular obtained from spread-coded pilot symbols. The delaying according to the invention of the signal streams which are in each case associated with one carrier means that these sections with chips that do not occur randomly do not occur at the same time so that no disturbing large-amplitude signal peaks can be produced in the multicarrier transmission signal.

Fundamentally, it is possible, in order to determine the signal structure timings of the carriers, for these timings to be signalled by component groups of the base station which occur earlier in the signal path. However, one preferred refinement of the method according to the invention is characterized in that in order to determine the signal structure timings of the carriers, the signal streams which are associated with the carriers are each superimposed, the superimposed signal streams are correlated with a reference sequence, and the correlation results are each subjected to signal peak detection. In this case, the reference sequence may be a synchronization sequence which occurs in time with the signal structure timing, and is associated with the carrier.

The apparatus according to the invention for reducing the dynamic range of a multicarrier transmission signal which is formed in a transmitter and is composed of two or more carriers has two or more carrier signal processing sections, with each carrier signal processing section having a delay element for delaying the signal streams which are associated with that carrier. Furthermore, the apparatus has a means for determining the signal structure timings of the carriers, as well as an evaluation means, which determines respective delays for the various carriers as a function of the determined signal structure timings and drives the delay elements with the respective delays in such a manner that the signal structures of different carriers or substructures of them are not aligned in time with respect to one another. A combiner is used to combine the outputs of the carrier signal processing sections in order to produce the multicarrier transmission signal.

BRIEF DESCRIPTION OF THE DRAWINGS

The apparatus according to the invention will be explained in the following text using examples and with reference to the drawings, in which.

DETAILED DESCRIPTION

The following explanations of examples of the invention relate to the production of a WCDMA downlink signal based on the UMTS Standard. It should be mentioned that the invention is not restricted to the example described in the following text but, for example, can also be implemented in systems based on the CDMA2000 Standard.

Figure 1:
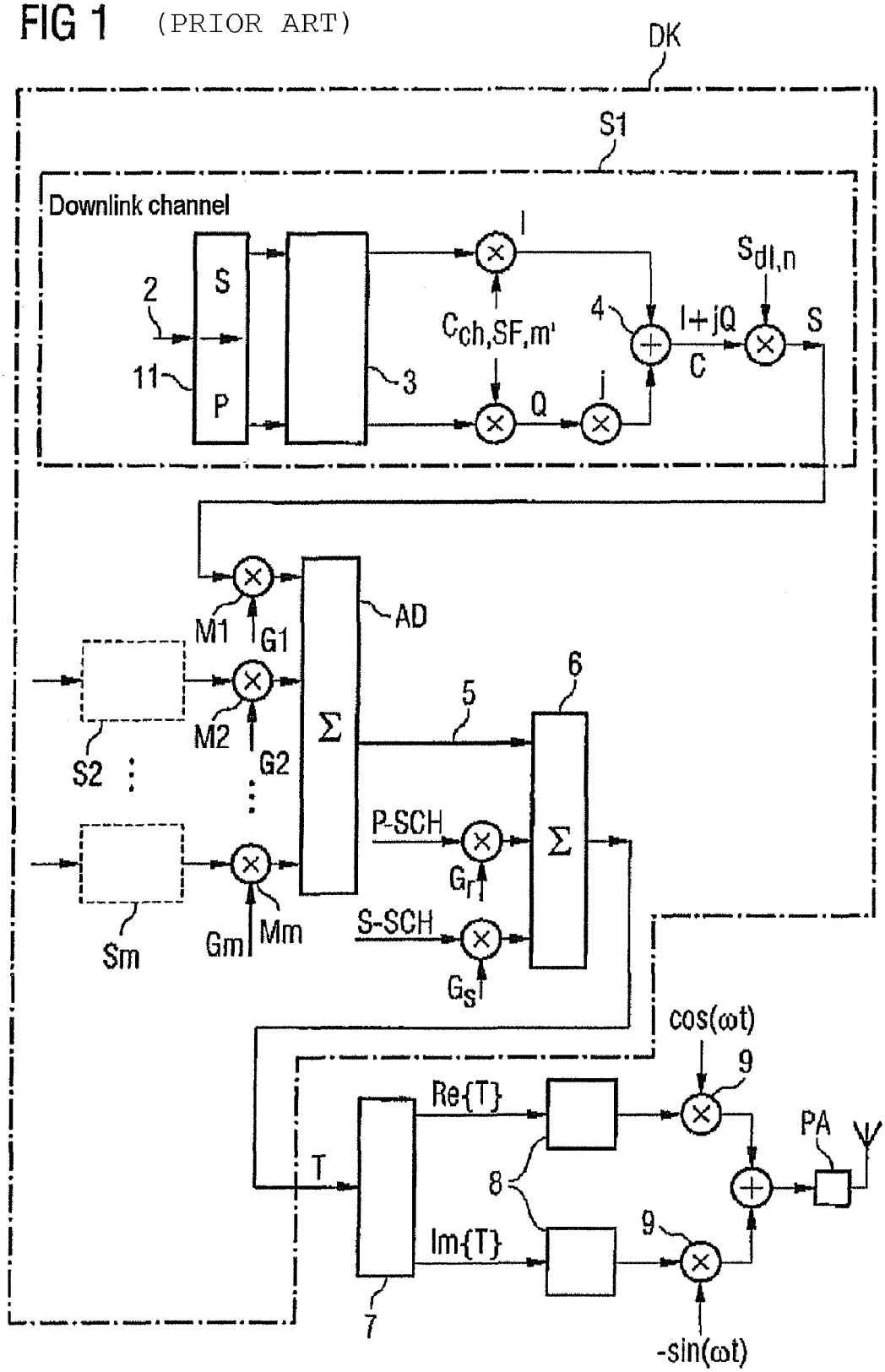
FIG 1 (PRIOR ART)
FIG. 1 shows a schematic illustration of the signal path for the modulation of a downlink signal using WCDMA.

FIG. 1 shows the modulation plan for production of a downlink signal for a single carrier. The modulation plan is defined in the 3GPP Standard TS 25.213 v5.3.0 (2003-03) *Spreading and Modulation* (*FDD*).

An adder AD is supplied with m modulated, spread-coded and weighted downlink signals. The m spread-coded, weighted signals may, for example, be intended for m subscribers. Each of the m spread-coded, weighted signals is produced by the series connection of a modulation and spread coding stage Si and of a multiplier Mi, i=1, 2, . . . , m. By way of example, FIG. 1 shows the design of the first modulation and spread coding stage S1. The design of the further modulation and spread coding stages S2, S3, . . . , Sm which are arranged in parallel is identical to S1.

The modulation and spread coding stage S1 has a series/parallel converter 1 on the input side. The series/parallel converter 1 receives a bit stream 2 on a first downlink channel, and converts this to two parallel bit streams. The two parallel bit streams are passed to a modulator 3, which carries out a modulation process (for example QPSK or 16 QAM). A complex, modulated signal (I and Q components) is produced at the output of the modulator 3. The two components of the complex, modulated signal are spread by multiplying them by a channelization code $C_{ch,SF,m'}$. The index ch denotes the channelization code associated with that bit stream, SF denotes the spreading factor and m' is the index of the arriving bit stream. The channelization codes $C_{ch,SF,m'}$ are OVSF spreading codes (Orthogonal Variable Spreading Factor), as defined in Section 4.3 of the 3GPP Standard TS 25.213 v5.3.0 (2003-03) Spreading and Modulation (FDD).

It should be mentioned that the bit streams 2 which arrive in the modulation and spread coding stages S1, S2, . . . , Sm may have different bit rates. Different channelization codes $C_{ch,SF,m'}$ are typically used in the individual modulation and spread coding stages S1, S2, . . . , Sm. After the channelization, each channel is at the same chip rate of 3.84 MHz.

The two signal components are then converted by multiplying the signal in the Q branch by the imaginary unit j, and by addition of the I and Q components in an adder 4 to form a complex data stream. This complex data stream is scrambled by means of a complex scrambling code $S_{dl,n}$. In principle, the UMTS Standard allows the use of different scrambling codes for the various channels (that is to say in the modulation and spread coding stages S1, S2, . . . , Sm). In order to ensure the orthogonality of the channelization codes $C_{ch,SF,m'}$ identical scrambling codes $S_{dl,n}$ are, however, typically used in practice in the modulation and spread coding stages S1, S2, . . . , Sm.

A modulated, spread-coded (that is to say channelized and scrambled) complex signal is produced at the point S in each modulation and spread coding stage S1, S2, . . . , Sm. These signals are multiplied in the respective multipliers M1, M2, . . . , Mm by a suitable weighting factor $G_1$, $G_2$, . . . , $G_m$ and, as already mentioned, are passed to the adder AD.

The multichannel signal 5 which is emitted from the adder AD is supplied to a further adder 6, in which two synchronization channels P-SCH (Primary Synchronization Channel) and S-SCH (Secondary Synchronization Channel) are superimposed after suitable weighting (weighting factors $G_p$ and $G_s$, respectively). A complex multichannel signal is produced at the point T, with superimposed synchronization codes P-SCH and S-SCH. The circuit section for production of such a complex multichannel signal is denoted by the reference symbol DK in FIG. 1.

This signal, which is produced at the chip clock rate at the point T, is split in a unit 7 into its real signal component Re{T} and its imaginary signal component Im{T}. The two real-value signals Re{T} and Im{T} are subjected to signal forming in identical RRC filters 8 (square root raised cosine filter with a roll-off factor of 22%). The two spectrally formed signals are up-mixed by means of two multipliers 9 by the use of radio-frequency signals cos(ωt) and sin(ωt) respectively, to the desired carrier frequency ω, are added and are passed to a power amplifier PA. The signal emitted from the power amplifier PA is transmitted via an antenna 10.

Figure 2:
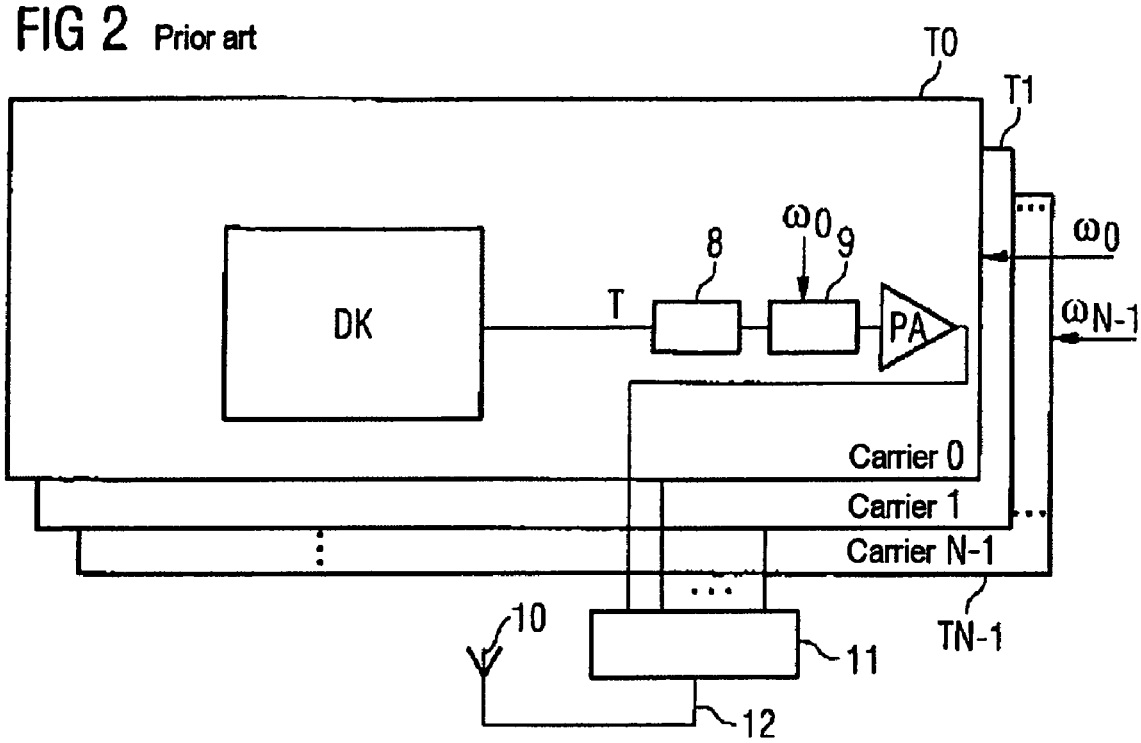
FIG 2 Prior art
FIG. 2 shows a schematic illustration of a block diagram for the design of a base station for transmitting a multicarrier transmission signal according to the prior art.

The signal processing path illustrated in FIG. 1 relates to the situation in which a multichannel signal is transmitted via a single carrier at the carrier frequency ω. FIG. 2 illustrates the design of a known base station, which transmits a number of multichannel signals via a total of N different carriers, specifically the carrier 0, the carrier 1, . . . , the carrier N-1. The associated signal processing circuits are annotated T0, T1, . . . , TN-1 and respectively essentially correspond to the signal processing path illustrated in FIG. 1, without the antenna 10. Identical components or components having the same effect are in this case denoted by the same reference symbols as in FIG. 1.

The outputs of the power amplifiers PA are passed to a summation stage 11. The summation stage 11 adds the transmission signals received from the individual carrier signal processing circuits T0, T1, . . . , TN-1 to form a multicarrier transmission signal 12, which is transmitted via the antenna 10.

The circuit design illustrated in FIG. 2 thus corresponds to an N-times copy of the signal processing path illustrated in FIG. 1. The respective carrier frequencies $\omega_0$, $\omega_1$, . . . , $\omega_{N-1}$ may be separated, for example, by 5 MHz. Since each power amplifier PA need amplify only the multichannel signal for one carrier, it is not subject to any more stringent requirements with respect to the linearity of its input dynamic range than for the power amplifier PA in FIG. 1. However, it has the disadvantage that N power amplifiers PA must be used.

Figure 3:
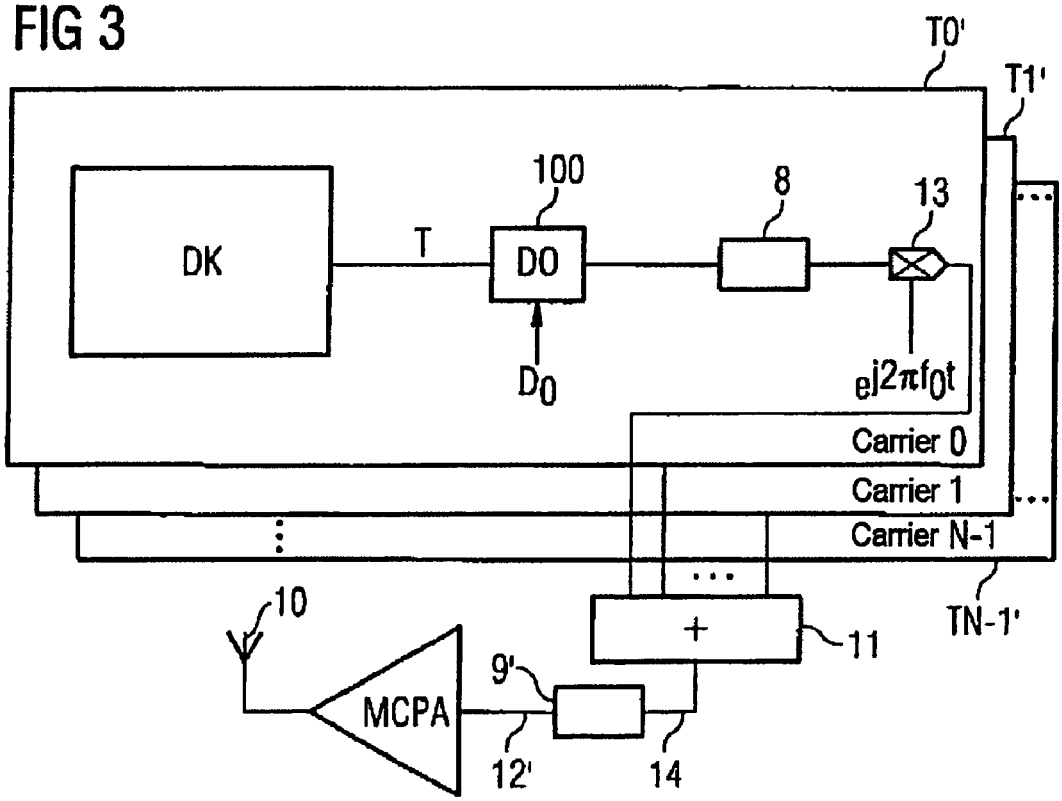
FIG. 3 shows a schematic illustration of a block diagram for the design according to the invention of a base station for transmitting a multicarrier transmission signal.

FIG. 3 shows the design of a base station according to the invention, once again with identical components or components having the same effect being annotated with the same reference symbols as in the previous figures. The major difference from the design illustrated in FIG. 2 is that only a single power amplifier MCPA (Multi Carrier Power Amplifier) is provided instead of the N power amplifiers PA, and is used to amplify the multicarrier transmission signal 12'. Furthermore, a delay element 100 (annotated as D0, D1, . . . , DN-1 in T0', T1', . . . TN-1') is provided in each carrier signal processing section T0', T1', . . . , TN-1', whose function will be explained in more detail later.

In the circuit design illustrated in FIG. 3, each multichannel signal which is emitted from the RCC filter 8 is up-mixed by means of a mixing stage 13 to a specific intermediate frequency $e^{j2\pi f_0 t}$ or $e^{j2\pi f_1 t}$, . . . , $e^{j2\pi f_{N-1} t}$. The frequency separation between the individual carriers in the intermediate-frequency band already corresponds to the required frequency separation between the carrier frequencies $\omega_0$, $\omega_1$, . . . , $\omega_{N-1}$. The adder 11 adds these intermediate-frequency signals. This results in a multicarrier transmission signal 14 in the intermediate-frequency band. This multicarrier intermediate-frequency signal is shifted to the desired carrier frequency band in the multiplier 9'. The multichannel power amplifier MCPA amplifies the multicarrier radio-frequency signal 12' which is produced at the output of the multiplier 9'. As already mentioned, the multichannel power amplifier MCPA requires a considerably wider input dynamic range with a linear characteristic for this purpose than a power amplifier PA in FIG. 2.

By way of example, in comparison to FIG. 2, the dynamic range of the multicarrier transmission signal at the input of the multicarrier power amplifier MCPA is 1 dB wider than the dynamic range of the individual carrier transmission signal at the input of the power amplifier PA in FIG. 2. In order to allow a cost-effective implementation of the multicarrier power amplifier MCPA, it is necessary to reduce the multicarrier transmission signal before the input to the multicarrier power amplifier MCPA.

Figure 4:
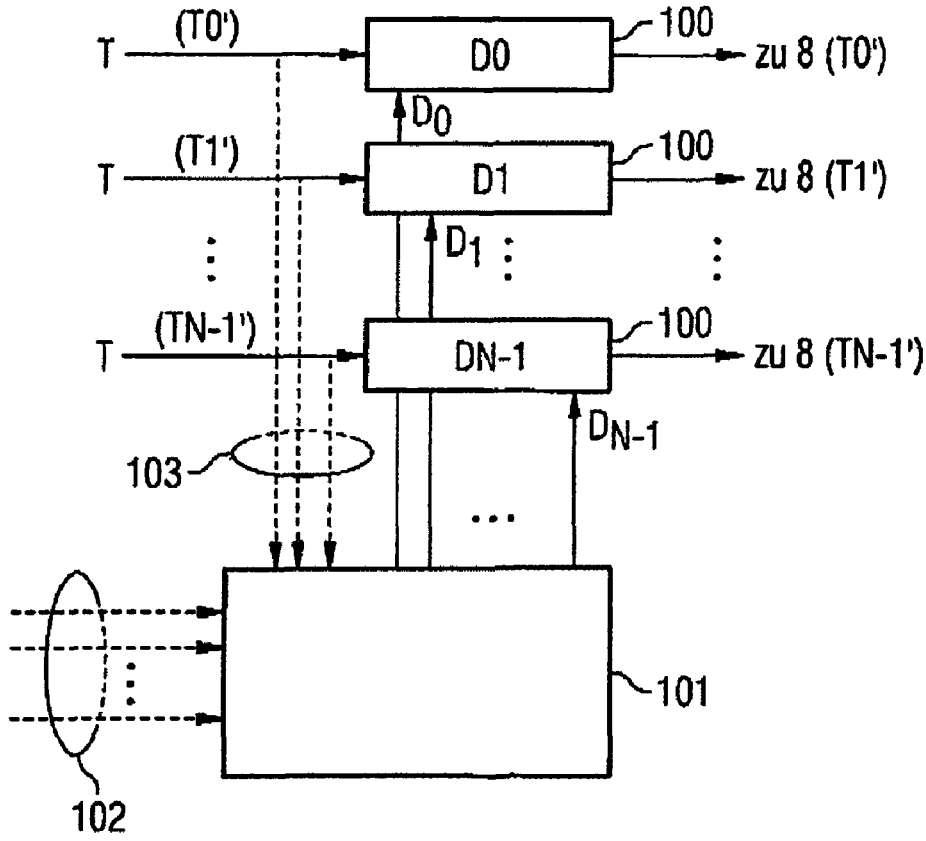
FIG. 4 shows a block diagram of the delay unit as illustrated in FIG. 3, with a delay time calculation unit.

FIG. 4 shows the design of a circuit according to the invention for reducing the dynamic range of the multicarrier transmission signal at the input of the multicarrier power amplifier MCPA. Each carrier signal processing circuit T0', T1', . . . , TN-1' has a delay element 100 or D0, D1, . . . , DN-1, whose input is connected to the point T in the respective carrier signal processing circuit, and whose input is connected to the RRC filter 8 of the respective carrier signal processing circuit. Furthermore, the circuit has a common delay time calculation unit 101. The delay time calculation unit 101 calculates the delays $D_0$, $D_1$, . . . , $D_{N-1}$ and signals the calculated delays to the respective delay elements 100 or D0, D1, . . . , DN-1.

Figure 7:
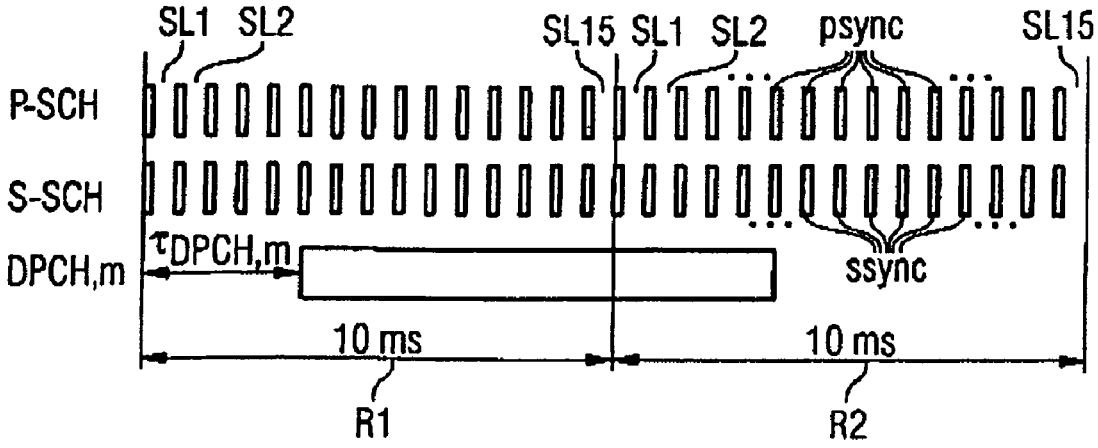
FIG. 7 shows a schematic illustration of the frame and time slot structure of a downlink channel DPCH for the UMTS Standard.

In order to assist understanding of the method of operation of the delay time calculation unit 101, the signal structure of a WCDMA signal is illustrated in FIG. 7. All of the modulated spread-coded signals which occur at the point S are organized into frames R1, R2, . . . with a time duration of 10 ms. Each frame R1, R2 is subdivided into 15 time slots SL1, SL2, . . . , SL15. Each time slot SL1, SL2, . . . , SL15 comprises 2560 chips. Each time slot SL1, SL2, . . . , SL15 can, furthermore, be subdivided into groups of SF chips, with SF indicating the spreading factor. A group of SF chips corresponds to one symbol in the modulated data stream before the spread coding. The maximum spreading factor SF in the UMTS Standard is SF=512.

The time slot clock rate is predetermined both by the first synchronization channel P-SCH and by the second synchronization channel S-SCH. Chip groups with a length of SF=256 chips are transmitted at the start of each time slot in both synchronization channels. The chip groups or synchronization sequences in the first synchronization channel P-SCH are identical, and are denoted by psync. In the second synchronization channel S-SCH, an identical sequence of 15 second synchronization sequences ssync is transmitted per frame.

The timings of the signal structure/substructure (frame or time slot or chip group) is identical for each carrier as shown in FIGS. 1 to 3, but may differ from one carrier to another. The delay time calculation unit 101 calculates the delays $D_0$, $D_1$, . . . , $D_{N-1}$ for the delay elements 100 or D0, D1, . . . , DN-1 in the individual carrier signal processing circuits T0', . . . , TN-1' as a function of the signal structure timings of the multichannel signals in the individual carrier signal processing circuits T0', . . . , TN-1' in such a way that the dynamic range of the multicarrier transmission signal 12' which is produced at the output of the adder 11 is reduced.

According to a first embodiment of the invention, the signal structure timings in the individual carrier signal processing circuits T0', . . . , TN-1' of the delay time calculation unit 101 can be signalled via control signals 102. The delay time calculation unit 101 then calculates the required time shifts (delays $D_0$, . . . , $D_{N-1}$) from the received signal structure timings.

According to a second embodiment of the invention, the signal structure timings are calculated from the multichannel signals received at the points T in the carrier signal processing circuits T0', . . . , TN-1'. For this purpose, these multichannel signals are passed via data links 103 to the delay time calculation unit 101. The delay time calculation unit 101 uses the received multichannel signals to calculate the timing of the signal structures (frame or time slot or group of SF chips) in each carrier signal processing circuit T0', . . . , TN-1'.

Figure 5:
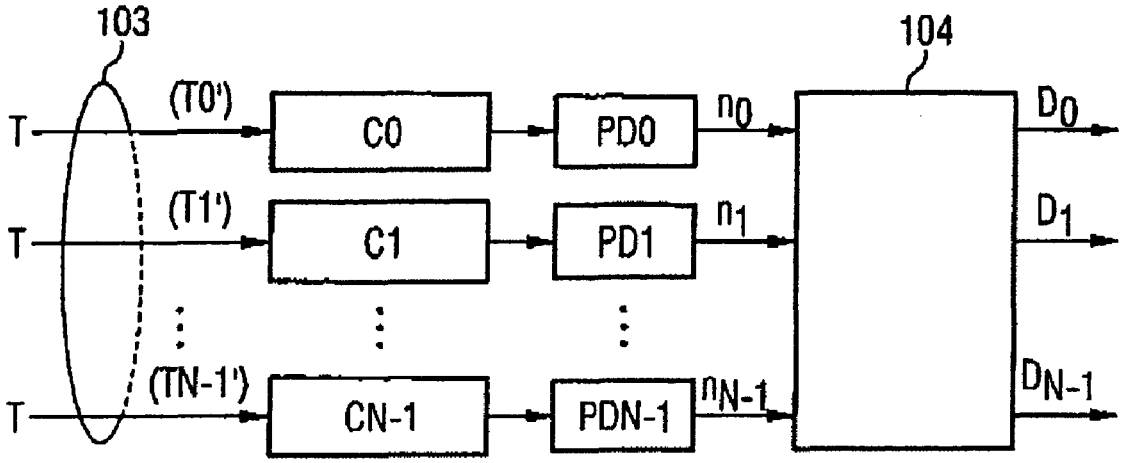
FIG. 5 shows a block diagram of one exemplary embodiment of the delay time calculation unit as illustrated in FIG. 4.

FIG. 5 shows one possible design for the delay time calculation unit 101 for the second embodiment. The delay time calculation unit 101 has N correlators C0, C1, . . . , CN-1 as well as N peak value detectors PD0, PD1, . . . , PDN-1 connected downstream from the correlators. The outputs of the peak value detectors PD0, PD1, PDN-1 are passed to a decision-making unit 104, which determines the delays $D_0$, $D_1$, . . . , $D_{N-1}$.

Depending on whether the timing of the frames, time slots or of chip groups comprising SF chips for the individual carrier signal processing circuits T0', . . . , TN-1' is intended to be calculated in the delay time calculation unit 101, the arriving multichannel signals are correlated with appropriate reference signals. If, for example, the time slot boundary is intended to be determined, the known synchronization code psync of the first synchronization signal P-SCH is used as the reference signal. A cross-correlation with the synchronization code ssync of the second synchronization channel S-SCH can be carried out in order to determine the frame boundary. The boundaries of chip groups can be determined, for example, after determination of the time slot boundary by counting the multiples of SF chips.

Figure 8:
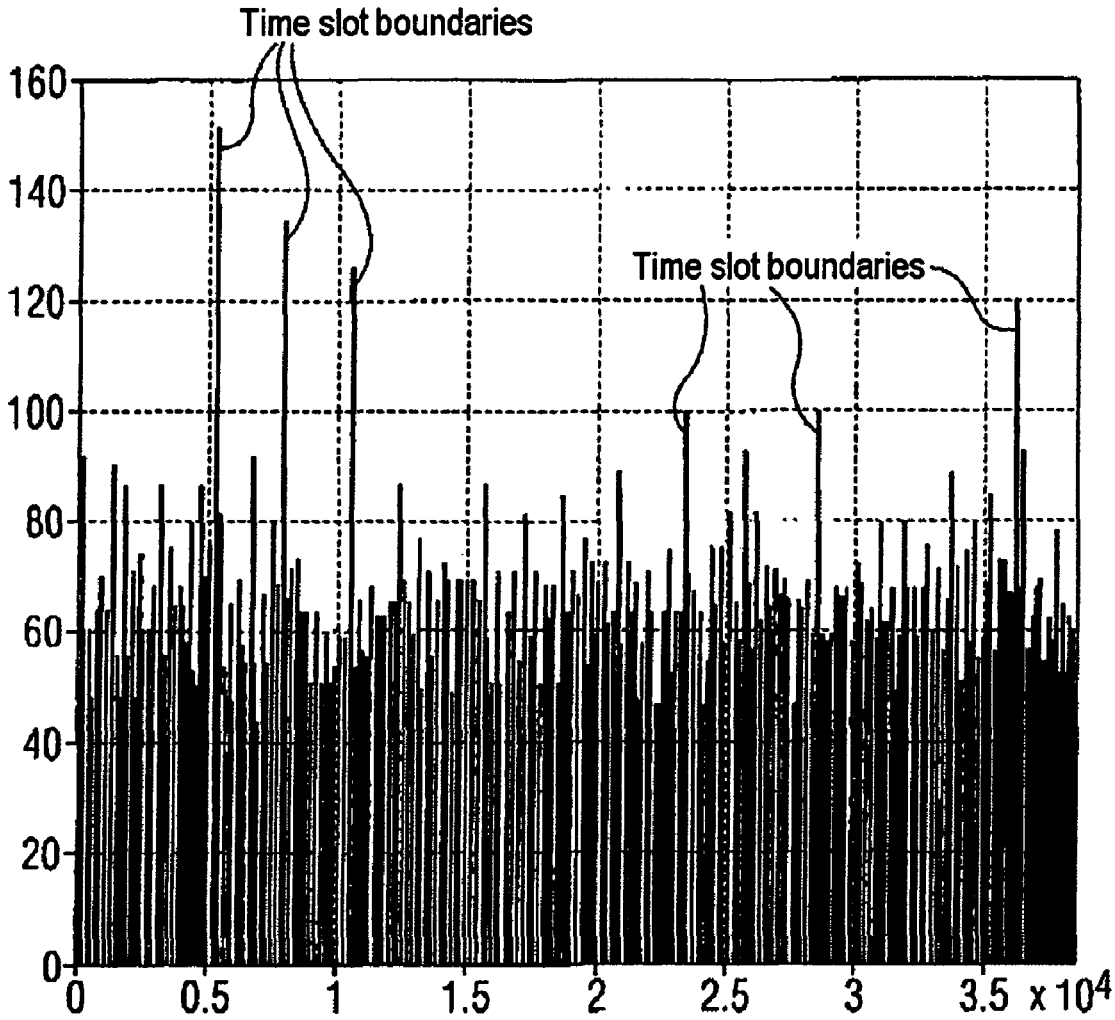
FIG. 8 shows a diagram illustrating the cross-correlation output signal for the channel P-SCH plotted against time.

FIG. 8 shows an example of the correlation signal at the output of a correlator C0, . . . , CN-1 when using the synchronization sequence psync of the first synchronization channel P-SCH as the reference sequence. Peaks in the correlation response indicate the time slot boundaries. These time slot boundaries are identified in the respective peak value detector PD0, PD1, . . . , PDN-1. The peak value detectors PD0, PD1, . . . , PDN-1 emit the timings of the time slot boundaries with respect to a common time base. The outputs of the peak value detectors PD0, PD1, . . . , PDN-1 may, for example, be numerical values $n_0, n_1, \ldots, n_{N-1}$ of a chip counter which is shared by all the peak value detectors PD0, PD1, . . . , PDN-1 and whose count is incremented with each chip. The differences between the signal structure/substructure timings can thus be calculated for example with respect to a frame (38 400 chips), with respect to a time slot (2560 chips), or else with respect to a spreading factor SF of interest (for example the maximum permissible spreading factor of SF=512 chips).

These numerical values $n_0, \ldots, n_{N-1}$ (that is to say the signal structure/substructure timings with respect to a common time base in the individual carrier signal processing circuits T0', . . . , TN-1') are signalled to the delay decision-making circuit 104. The delay decision-making circuit 104 analyses the time relationship between the time structures (frame/time slot/chip group composed of SF chips) between different carriers, and decides on the appropriate delays $D_0, \ldots, D_{N-1}$.

The following text explains why the process of presetting different delays $D_0, D_1, \ldots, D_{N-1}$ in the individual carrier signal processing circuits T0', . . . , TN-1' allows the dynamic range of the multicarrier transmission signal to be reduced.

If the occurrence of chips in the signals emitted from the carrier signal processing circuits T0' . . . T-N1' were completely random, it would not be possible to reduce the dynamic range in the multicarrier transmission signal 12' by means of an appropriate time delay for these signals. However, this is not the case in WCDMA. The 3GPP Standard TS 25.211 v5.4.0 (2003-06) Physical Channels and Mapping of Transport Channels onto Physical Channels (FDD) states that specific bits are used as pilot bits in the signal structure of the DPCH channel (DPCH: Dedicated Physical Channel). During the same time slot, all of the DPCH channels which are associated with the same service class use the same sequence of pilot bits. DPCH channels which are associated with different service classes can likewise use the same sequence of pilot bits.

Even though each DPCH channel is spread using a different OVSF canalization code, the first chip in each canalization code always has the value +1. This means that, during addition of the DPCH channels (in the same service class), this first chip of the pilot bits is constructively added, and results in a large signal peak. This large signal peak occurs in each time slot in each frame. It should be noted that this signal peak occurs in the first chip of a block of 256 chips irrespective of the value assumed for the spreading factor SF. If SF=128, the signal peak occurs at the first bit and additionally at the 128th bit. If SF=64, signal peaks occur at the first bit and additionally at the 64th, 128th, . . . etc. bit in the block of 256 chips.

In the UMTS Standard, different DPCH channels can in each case occur offset in time by a multiple of 256 chips with respect to one another. That is to say, with respect to FIG. 7, this means that $\tau_{DPCH,m'}-\tau_{DPCH,m''}=n\times256$ chips where m', m" indicate different DPCH channels. In typical situations, such as the test modes 1 and 3 (defined in the 3GPP Standard TS 25.141 v6.2.0 (2003-06) Base Station (BS) Conformance Testing (FDD) this can mean that the DPCH channels are not all constructively added. Some of the pilot bits will overlap data bits (that is to say randomly distributed bits) and thus cannot cause signal peaks. Nevertheless, despite this, some of the pilot bits can still occur at the same time (overlapping), so that signal peaks can occur in each time slot, in each frame, . . . .

Time matching (alignment) between the carriers can, on the other hand, lead to signal peaks occurring with the same periodicity in all of the carriers. These signal peaks are added in the multicarrier transmission signal to form even larger signal peaks, with there being a high probability of them occurring at the same position in each time slot.

Figure 6:
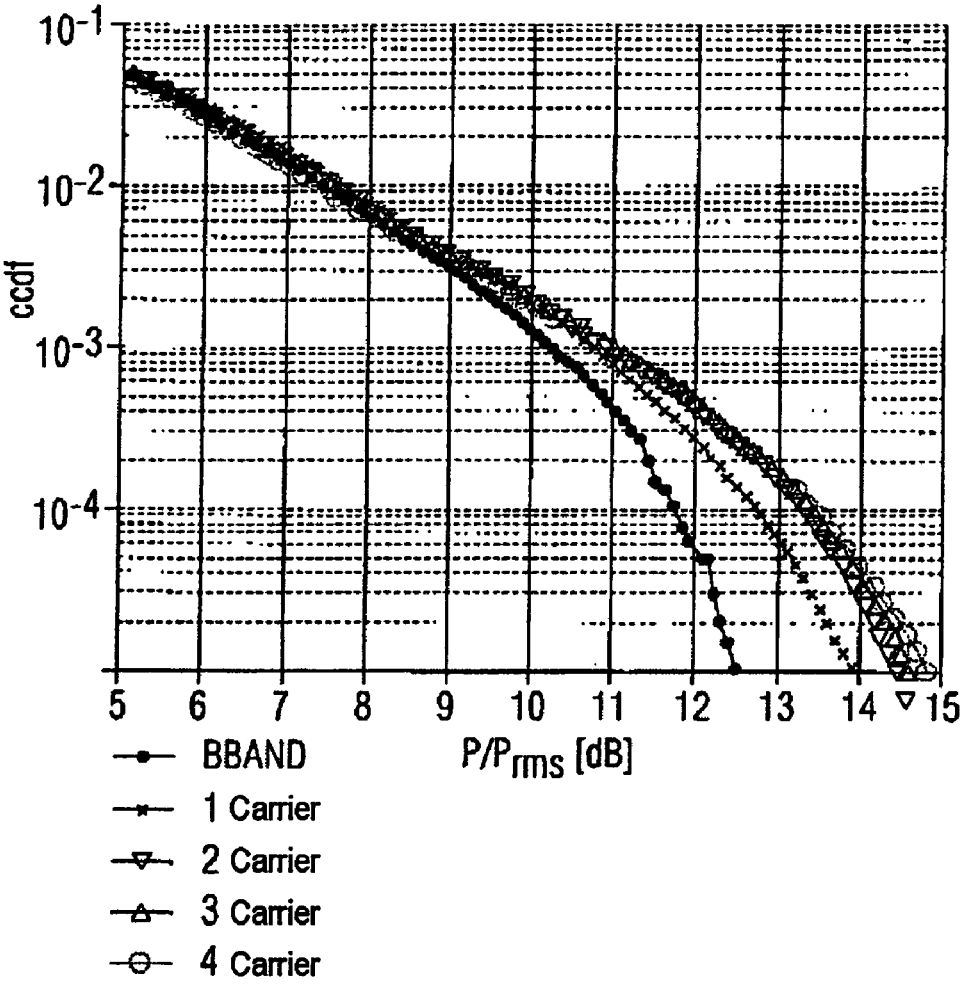
FIG. 6 shows a diagram illustrating the complementary cumulative distribution function (ccdf) of the multicarrier transmission signal for the circuit illustrated in FIG. 3 in baseband and for 1 to 4 carrier signals at the antenna.

The distribution of the signal power can be illustrated by the so-called complementary cumulative distribution function (ccdf). FIG. 6 shows the ccdf for the circuit illustrated in FIG. 3, for the situation where $D_0=D_1=\ldots=D_{N-1}=0$ (that is to say without the delay according to the invention of the individual carrier signals) for the test mode 3. For the situations where N=1, 2, 3, 4, the ccdf is illustrated on the antenna, and the curve BBAND indicates the ccdf for a single carrier signal in baseband (BBAND) at the point T within a carrier signal processing circuit T0', T1', . . . , TN-1', respectively. The Y axis represents the probability of the instantaneous signal power being greater than the value on the X axis.

By way of example, the value ccdf=$10^{-4}$ is used as the probability value for the definition of the dynamic range of a signal. FIG. 6 shows that the baseband signal BBAND at the point T has a dynamic range of virtually 12 dB with respect to its rms value (root mean square value). Furthermore, it should be noted that the dynamic range is 1 dB greater when the subsequent signal processing is taken into account (the curve for N=1). As can also be seen from FIG. 6, the already mentioned increase in the dynamic range occurs taking into account two or more (N=2, 3, 4) carriers.

Figure 9:
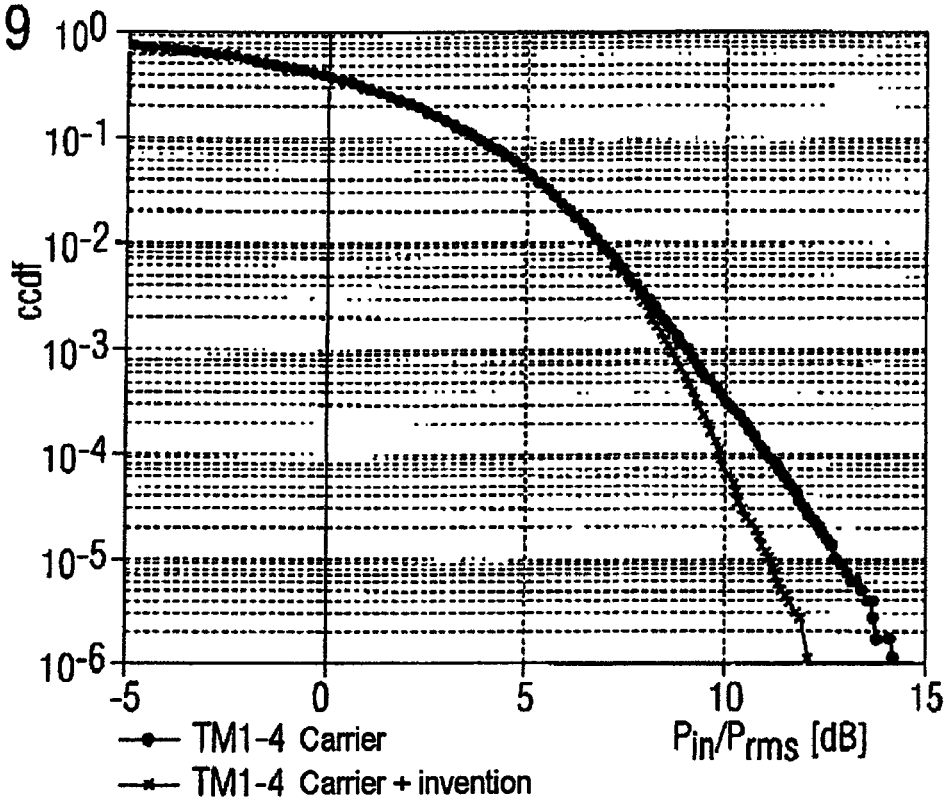
FIG. 9 shows a diagram illustrating the complementary cumulative distribution function (ccdf) of the antenna signal for four carriers according to the prior art and according to the invention, in a test mode 1.
Figure 10:
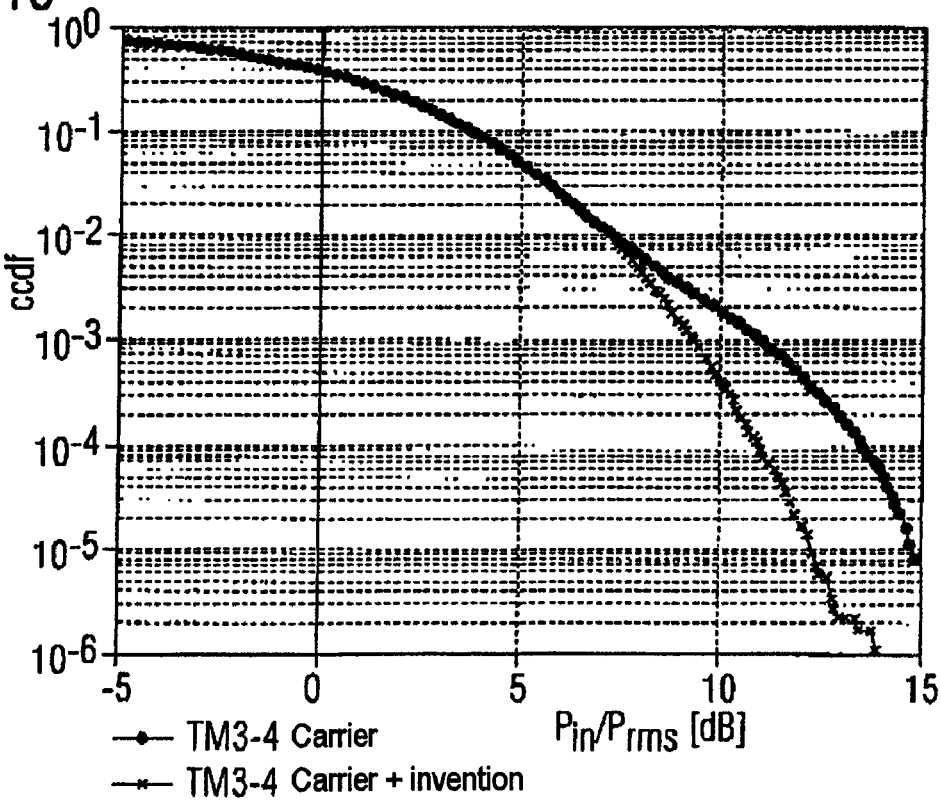
FIG. 10 shows a diagram illustrating the complementary cumulative distribution function (ccdf) of the antenna signal for four carriers according to the prior art and according to the invention, in a test mode 3.

FIGS. 9 and 10 show the ccdf for a multicarrier transmission signal with N=4 without and with the use of the method according to the invention. FIG. 9 relates to the test mode 1, and FIG. 10 relates to the test mode 3. The reduction in the dynamic range for ccdf=$10^{-4}$ may be greater than 2 dB (see FIG. 10). Simulation calculations have shown that, in the test mode 3, the method according to the invention allows an improvement in the quality variables EVM from 11.7% to 6.7%, and in the quality variables PCDE from −37.9 dB to −43.7 dB. It should be noted that the reduction in the dynamic range of the multicarrier transmission signal according to the invention is achieved without having to accept any signal distortion.

The curves illustrated in FIGS. 9 and 10 for the situation according to the invention were obtained as follows: first of all, it was found that the signal structure timings of the four different carriers were aligned with respect to one another, with respect to a substructure of 256 chips. In order to cancel out this alignment, the delays were set to be $D_0=0$ chips, $D_1=3$ chips, $D_2=7$ chips and $D_3=12$ chips. The curves illustrated in FIGS. 9 and 10 were obtained using this delay profile. Other delay values which likewise break up the time alignment of the carrier signals with respect to the substructure are, of course, also possible.

Since the alignment of the individual carrier signals occurred with respect to a substructure of SF=256 chips, it is sufficient, in terms of implementation, in this case to use a modulo-256 counter in the peak value detectors PD0, PD1, . . . , PDN-1. A corresponding situation occurs when time shifts over greater time periods (time slot or frame) are required.

It should be noted that the method according to the invention can be combined with the "signal-distorting" method described for the prior art. This is particularly advantageous when the method according to the invention does not itself result in the desired dynamic range reduction being entirely achieved, but is sufficiently great that the signal distortion which is caused by the known method being used in addition can be accepted without any difficulties (that is to say without infringing the quality requirements).

I claim:

1. A method for reducing the dynamic range of a multicarrier transmission signal which is formed in a transmitter and is composed of at least two carriers, with each carrier having specific associated signal streams, and the signal streams having the same repeating signal structure, wherein the signal structure is a frame or a time slot or a chip group, and wherein, for the at least two carriers, signal streams which are associated with the same carrier have a common signal structure timing, the method comprising:

determining at least one time of a signal structure boundary for each of the at least two carriers;

determining a delay for each of the at least two carriers based on the times of the signal structure boundaries;

delaying all the signal streams which are associated with one carrier using the delay determined for the carrier such that non-random signal sections of identical signal values of signal streams associated with different carriers are not aligned in time with respect to one another; and producing the multicarrier transmission signal by combination of the signal streams of the carriers, wherein the delay results in identical signal values of at least two non-random signal sections associated with the at least two carriers not being superimposed on one another so they do not add constructively in the multicarrier transmission signal.

2. A method according to claim 1, wherein the carriers are converted to non-overlapping frequency bands.

3. A method according to claim 1, wherein a substructure is a chip group comprising SF chips, where SF is a spreading factor.

4. A method according to claim 1, wherein the signal streams comprise a sequence of chips, produced by spread coding of symbols, and the signal streams in each signal structure or substructure comprise a section with chips which do not occur randomly, in particular obtained from spread-coded pilot symbols.

5. A method according to claim 1, wherein in order to determine the times of the signal structure boundaries of the carriers:

the signal streams which are associated with the carriers are each superimposed;

the superimposed signal streams are correlated with a reference sequence; and the correlation results are each subjected to signal peak detection.

6. A method according to claim 5, wherein each carrier furthermore has an associated synchronization signal in which a synchronization sequence occurs in time with the signal structure timing, and with the synchronization sequence being the reference sequence.

7. A method according the claim 1, wherein the multicarrier transmission signal is a WCDMA signal, in particular a multicarrier transmission signal which is intended for the FDD mode in the UMTS Standard.

8. The method according to claim 1, wherein the at least two non-random signal sections of identical signal values are pilot sections.

9. An apparatus for reducing the dynamic range of a multicarrier transmission signal which is formed in a transmitter and is composed of at least two carriers, wherein each carrier has specific associated signal streams, signal streams have the same repeating signal structure, and for the at least two carriers, signal streams which are associated with the same carrier have a common signal structure timing, wherein the signal structure is a frame or a time slot or a chip group, comprising two or more carrier signal processing sections, with each carrier signal processing section having an associated delay element for delaying all the signal streams which are associated with that carrier, means for determining at least one time of a signal structure boundary for each of the at least two carriers, an evaluation means, which determines a respective delay for each of the at least two carriers as a function of the determined times of the signal structure boundaries and drives the delay elements with the respective delays in such a manner that non-random signal sections of identical signal values of signal streams associated with different carriers are not aligned in time with respect to one another, and a combiner which receives the outputs from the carrier signal processing sections in order to produce the multicarrier transmission signal, wherein the delay results in identical signal values of at least two non-random signal sections associated with the at least two carriers not being superimposed on one another so they do not add constructively in the multicarrier transmission signal.

10. An apparatus according to claim 9, wherein each carrier signal processing section has a frequency mixing stage, with the mixing stages of the carrier signal processing sections converting the carriers to non-overlapping frequency bands.

11. An apparatus according to claim 9, wherein a substructure is a chip group comprising SF chips, where SF is a spreading factor.

12. An apparatus according to claim 9, wherein each carrier signal processing section has two or more spreading coders which use spread coding of symbols to produce the signal streams as a sequence of chips, and the signal streams in each signal structure or substructure comprise a section with chips which do not occur randomly, in particular obtained from spread-coded pilot symbols.

13. An apparatus according to claim 9, wherein each carrier signal processing section comprises:

a combiner which superimposes the signal streams associated with the carrier, a correlator, which correlates the superimposed signal streams with a reference sequence, in particular with a synchronization signal associated with the carrier, and a signal peak detector, which subjects the correlation results to signal peak detection.

14. An apparatus according to claim 13, wherein the combiner furthermore superimposed a synchronization signal on the mutually superimposed signal streams, in which a synchronization sequence occurs in time with the signal structure timing, and with the synchronization sequence being the reference sequence.

15. An apparatus according to claim 9, comprising an amplifier for amplification of the multicarrier transmission signal.

16. An apparatus according to claim 9, wherein the apparatus is designed to produce a WCDMA multicarrier transmission signal, in particular a multicarrier transmission signal which is intended for the FDD mode in the UMTS Standard.

17. The apparatus according to claim 9, wherein the at least two non-random signal sections of identical signal values are pilot sections.

18. An apparatus for reducing the dynamic range of a multicarrier transmission signal which is formed in a transmitter and is composed of at least two carriers with specific associated signal streams that comprise a same repeating signal structure and a common signal structure timing, wherein the signal structure is a frame or a time slot or a chip group, the apparatus comprising:

two or more carrier signal processing sections, each carrier signal processing section comprising an associated delay element for delaying all the signal streams which are associated with that carrier, means for determining at least one time of a signal structure boundary for each of the at least two carriers, an evaluation means for determining a respective delay for each of the at least two carriers as a function of the determined times of the signal structure boundaries and for driving the delay elements with the respective delays in such a manner that non-random signal sections of identical signal values of signal streams associated with different carriers are not aligned in time with respect to one another, and a combiner for generating the multicarrier transmission signal from the carrier signal processing sections, wherein the delay results in identical signal values of at least two non-random signal sections associated with the at least two carriers not being superimposed on one another so they do not add constructively in the multicarrier transmission signal.

19. An apparatus according to claim 18, wherein each carrier signal processing section has a frequency mixing stage, with the mixing stages of the carrier signal processing sections converting the carriers to non-overlapping frequency bands.

20. An apparatus according to claim 18, wherein the signal structure is a frame or a time slot.

21. The apparatus according to claim 18, wherein the at least two non-random signal sections of identical signal values are pilot sections.

22. A method for reducing the dynamic range of a multicarrier transmission signal which is formed in a transmitter and is composed of at least two carriers, with each carrier having specific associated signal streams, and the signal streams having the same repeating signal structure, and wherein, for the at least two carriers, signal streams which are associated with the same carrier have a common signal structure timing, the method comprising:

determining at least one signal structure timing for each of the at least two carriers;

determining a delay for each of the at least two carriers based on the timings of the signal structure boundaries;

delaying all the signal streams which are associated with a carrier by at least one chip time such that the signal structures of different carriers or substructures of such signal structures are not aligned in time with respect to one another; and producing the multicarrier transmission signal by combination of the signal streams of the carriers, wherein the delay results in identical signal values of at least two non-random signal sections of signal streams associated with the at least two carriers not being superimposed on one another so they do not add constructively in the multicarrier transmission signal.

23. An apparatus for reducing the dynamic range of a multicarrier transmission signal which is formed in a transmitter and is composed of at least two carriers, with specific associated signal streams that comprise a same repeating signal structure and a common signal structure timing, the apparatus comprising:

at least two carrier signal processing sections, each carrier signal processing section comprising an associated delay element for delaying all the signal streams which are associated with that carrier by at least one chip time;

means for determining at least one time of a signal structure boundary for each of the at least two carriers;

means for determining a respective delay for each of the at least two carriers as a function of the determined times of the signal structure boundaries and for driving the delay elements with the respective delays in such a manner that the signal structures of different carriers or substructures of such signal structures are not aligned in time with respect to one another; and a combiner for generating the multicarrier transmission signal from the carrier signal processing sections, wherein the delay results in identical signal values of at least two non-random signal sections of signal streams associated with the at least two carriers not being superimposed on one another so they do not add constructively in the multicarrier transmission signal.

* * * * *